US005579840A

United States Patent [19]

Saurer

[11] Patent Number: 5,579,840

[45] Date of Patent: Dec. 3, 1996

[54] PACKER RUNNING AND SETTING TOOL

[75] Inventor: Dan P. Saurer, Richardson, Tex.

[73] Assignee: Dresser Industries, Inc., Dallas, Tex.

[21] Appl. No.: 318,243

[22] Filed: Oct. 5, 1994

[51] Int. Cl.[6] ..... E21B 23/06

[52] U.S. Cl. ..... 166/123; 166/134; 166/216

[58] Field of Search ..... 166/118, 120, 166/123, 124, 125, 133, 134, 212, 216

[56] References Cited

U.S. PATENT DOCUMENTS

| | | | |
|---|---|---|---|
| 3,321,016 | 5/1967 | Lance . | |
| 3,678,998 | 7/1972 | Cockrell et al. | 166/123 |
| 3,785,436 | 1/1974 | Davis, Jr. | 166/120 |
| 3,952,804 | 4/1976 | Smyrl . | |
| 3,987,854 | 10/1976 | Callihan et al. . | |
| 4,180,132 | 12/1979 | Young . | |
| 4,388,971 | 6/1983 | Peterson . | |
| 4,401,158 | 8/1983 | Spencer et al. . | |
| 4,516,634 | 5/1985 | Pitts . | |
| 4,605,064 | 8/1986 | Akkerman . | |
| 4,624,311 | 11/1986 | Goad . | |
| 4,628,998 | 12/1986 | Akkerman . | |
| 4,660,637 | 4/1987 | McGill et al. . | |
| 4,664,188 | 5/1987 | Zunkel et al. | 166/134 |
| 4,688,634 | 8/1987 | Lustig et al. . | |
| 4,712,621 | 12/1987 | Wightman et al. . | |
| 4,726,419 | 2/1988 | Zunkel | 166/51 |
| 4,796,707 | 1/1989 | Halbardier . | |
| 4,832,129 | 5/1989 | Sproul et al. . | |
| 4,856,591 | 8/1989 | Donovan et al. . | |
| 4,862,957 | 9/1989 | Scranton . | |
| 4,915,172 | 4/1990 | Donovan et al. . | |
| 4,967,844 | 11/1990 | Brooks et al. . | |
| 4,989,672 | 2/1991 | Burns, Sr. et al. . | |
| 5,044,441 | 9/1991 | Rubbo et al. | 166/120 X |
| 5,086,843 | 2/1992 | Mims et al. . | |
| 5,086,844 | 2/1992 | Mims et al. . | |
| 5,103,902 | 4/1992 | Ross et al. . | |
| 5,109,926 | 5/1992 | Mody et al. . | |
| 5,133,412 | 7/1992 | Coronado . | |
| 5,170,847 | 12/1992 | Mims et al. . | |
| 5,180,010 | 1/1993 | Stout et al. . | |

OTHER PUBLICATIONS

1–Page Publication entitled "Tech Update", vol. 2, No. 2, Baker Sand Control (1988).

1–Page Publication entitled "Horizontal Application", Baker Sand Control (1992).

1–Page Publication entitled "Multifunctional Gravel Pack Simplifies Horizontal Completions", Petroleum Engineer International (Nov. 1993).

2–Page Brochure entitled "Gravel Pack Equipment and Accessories", Otis (Copyright 1991).

1–Page Ad entitled "Innovative", Guiberson AVA Dresser (Jul. 1994).

*Primary Examiner*—Frank S. Tsay

*Attorney, Agent, or Firm*—Vaden, Eickenroht, Thompson & Feather

[57] ABSTRACT

There is disclosed a running tool for running and setting and then releasing from a well packer of the type having a main body and a setting sleeve vertically shiftable on the main body to set the packer. The setting tool includes a mandrel carrying a latch having left-hand threads for engaging left-hand threads on the body of the packer as well as teeth adapted to engage in notches in the upper end of the packer body to prevent right-hand rotation of the setting tool with respect to the packer as the packer is run on the setting tool into the well bore. When the packer is at the desired level, fluid pressure in the setting tool lowers the setting sleeve to set the packer and releases the setting tool from connection to the packer so that it may be retrieved.

8 Claims, 5 Drawing Sheets

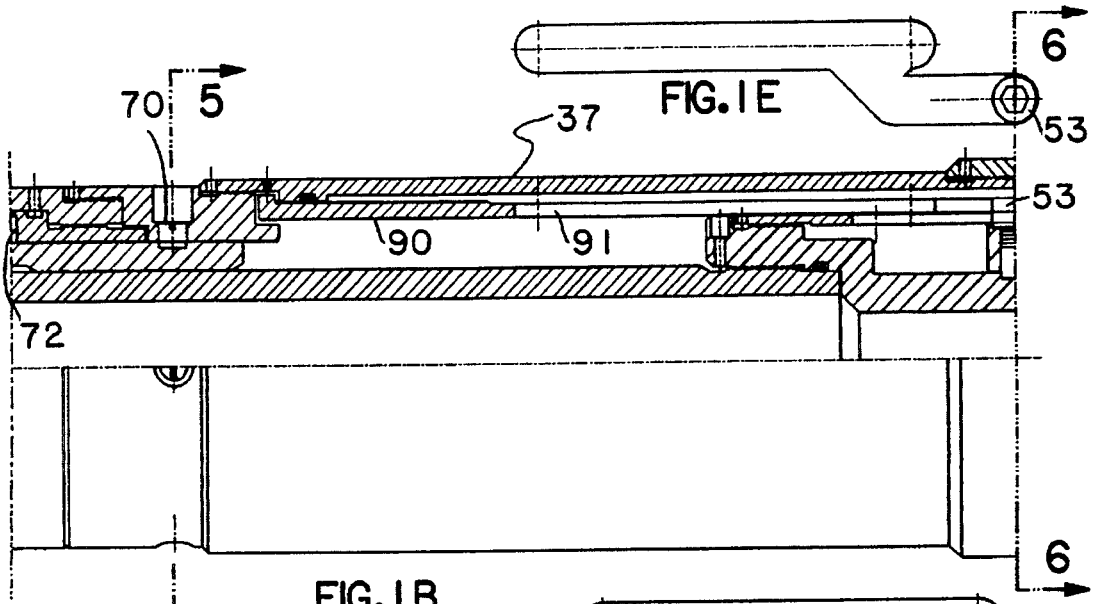
FIG. 1E
FIG. 1B
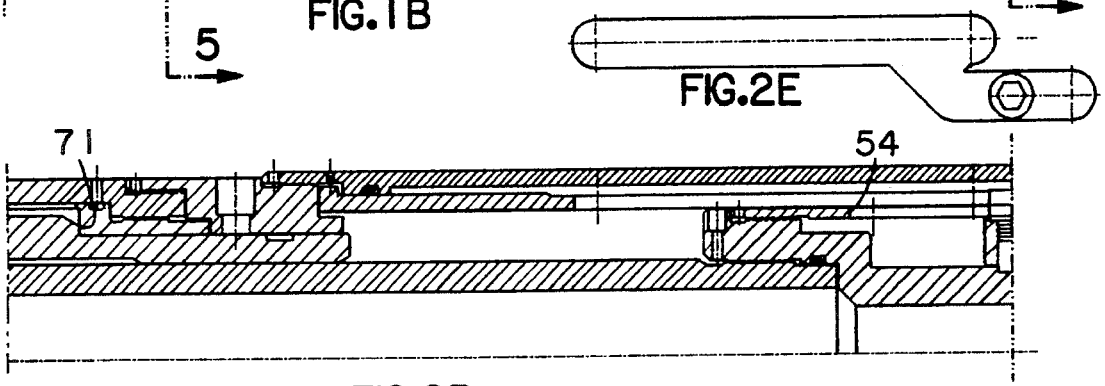
FIG. 2E
FIG. 2B
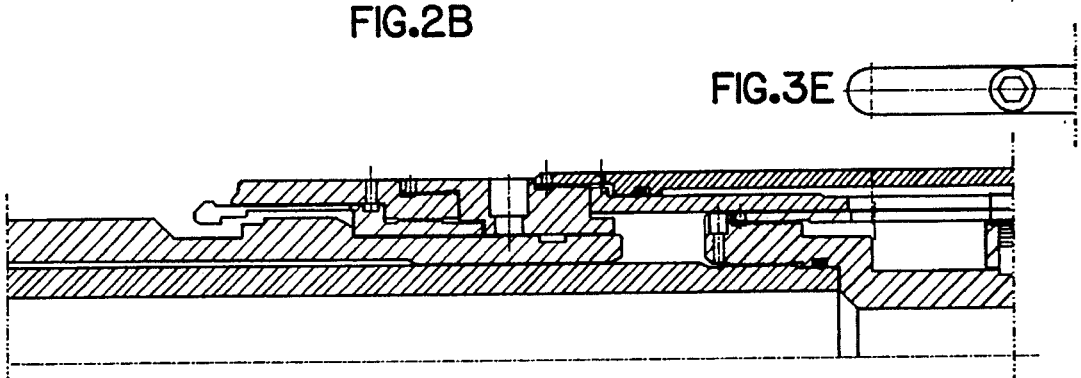
FIG. 3E
FIG. 3B
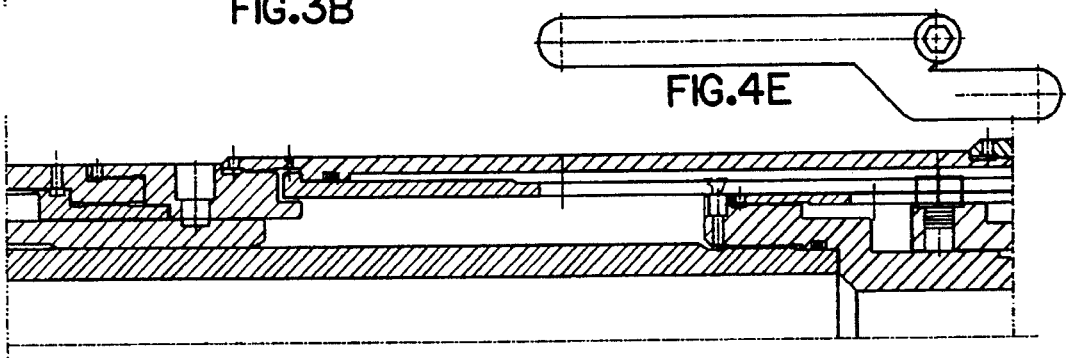
FIG. 4E
FIG. 4B

PACKER RUNNING AND SETTING TOOL

FIELD OF THE INVENTION

This invention relates generally to a tool for use in running and setting a well packer and then releasing therefrom, following setting, to permit the tool to be retrieved from the well bore. More particularly, it relates to improvements in a tool of this type for use with a packer having a body with left-hand threads engageable by left-hand threads on the collet fingers of a latch ring of the tool to support the body of the packer therefrom as it is lowered into the well bore, and a setting sleeve which is lowered relative to the body to set the packer, when lowered to a desired level, by lowering of a piston on the tool, in response to fluid pressure in the mandrel of the tool, and to release the engagement of the collet fingers to permit the tool to be retrieved in response to fluid pressure in the annulus above the set packer.

DESCRIPTION OF THE INVENTION

A tool of the type above described, and known as the type "HRH" (Hydraulic Release Hydraulic Setting tool), has been made and sold by the Guiberson/AVA Division of Dresser Industries, Inc. As in other tools of this type, the left-hand threaded connection to the packer enables the tool to be rotated to the right to release it from the packer without risk of disconnecting the right-hand threaded connection of the tool to the well string on which it is run. Although a substantial advance over the prior art, the above described tool, like others similar to it, could encounter difficulties if run into horizontal or deviated well bores. Thus, in these instances, it may be necessary to manipulate the pipe string so as to force it through the sharp bend between the vertical and horizontal portions of the well bore. For example, it may be necessary to rotate the string, in which case frictional engagement of the packer with the well bore during right-hand rotation could disconnect the left-hand threads. Also, it may be necessary to lift the string in which case frictional engagement of the setting sleeve of the packer with the well bore could cause it to set prematurely.

SUMMARY OF THE INVENTION

The object of this invention is to provide a running and setting tool of the type above described in which one, or preferably both, of the above described problems are overcome in that the tool may be rotated to the right and/or reciprocated in tight areas of the well bore without risk of disconnecting it from and/or prematurely setting the packer.

It is a more particular object of the invention to accomplish these results by a tool which is of such construction that movement of a single piston in one direction releases an otherwise rigid, non-shearable vertical connection between the mandrel of the tool and the setting sleeve of the packer and the threads of the latch from those of the packer, prior to setting the packer, and then, upon setting of the packer, and movement of the piston in the other direction, in response to fluid pressure in the annulus above the set packer, permits retrieval of the tool from the packer.

These and other objects are accomplished, in accordance with the illustrated embodiment of the present invention, by a tool which comprises a mandrel adapted to be suspended from a pipe string and having a bore therethrough, an annular chamber about the bore, and a port connecting its bore with the chamber, and an annular piston vertically reciprocable in the chamber between upper and lower positions, with means holding said piston in its upper position but releasable to permit the piston to be moved toward its lower position in response to the supply through the port of fluid pressure thereto from within the mandrel bore.

As in the prior tool, means including a tubular member is lowerable with the piston to engage and lower the packer setting sleeve to packer setting position, and a latch is carried by the mandrel and has collet fingers with left-hand threads thereabout engageable with those of the packer body. More particularly, a first sleeve is carried by the mandrel for vertical movement with respect thereto between a first vertical position holding the latch threads of the collet fingers engaged with those of the packer body, to suspend the packer therefrom, and a second vertical position releasing the collet fingers and thus the threads thereon for retraction from those of the packer body, and means are provided for releasably connecting the first sleeve to the mandrel to hold the first sleeve in its first vertical position.

In accordance with one novel aspect of the invention, a second sleeve is carried by the tubular member and has teeth thereabout which are received in upwardly facing notches formed in the packer body and which have abrupt sides opposite with abrupt sides of the notches, when so received, and means are provided for holding the second sleeve against rotation with respect to the mandrel so as to prevent rotation of the tool in a right-hand direction with respect to the packer body, as the packer is lowered with the tool into the well bore. More particularly, the piston is raised from its lower to its upper position, in response to fluid pressure in the annulus about the tool above the set packer, and means are provided for lifting the tubular member with the piston responsive to lifting of the piston for releasing the connection of the first sleeve to the mandrel and raising said first sleeve to its second vertical position to permit the latch to disengage from the packer body, together with means for continuing to lift the latch with the first sleeve and lift the first and second sleeves with the tubular member to permit the tool to be retrieved from the packer as the piston continues to be raised.

In the preferred and illustrated embodiment of the invention, means are also provided for holding the latch for rotation with the first sleeve, and for releasing such holding means, as the tubular member is lowered, so as to permit the latch to be rotated with the mandrel in order to release it from the packer body, thus permitting the latch to be manually released if necessary. As shown, the releasable holding means comprises a key releasably connected to the mandrel and vertically slidably interfitting with the mandrel and second sleeve, and means on the tubular member for moving the key out of slidable interfitting relation with the mandrel in response to lowering of the tubular member with the piston. More particularly, as shown, the tubular member includes a third sleeve which is rotatable with respect to the mandrel and engageable with the key to lower it.

The third sleeve having a J-slot therein, and the mandrel has a slot opposite the J-slot. The first sleeve has a pin for sliding within the slot in the mandrel and the J-slot in the third sleeve and engageable by a shoulder on the J-slot to permit the first and second sleeves to be raised with the third sleeve upon release of the first sleeve from the mandrel.

In accordance with another novel aspect of the invention, the ends of the tubular member are releasably connected to the mandrel and setting sleeve, and the tubular member is shearably connected to the piston so that the ends of the tubular member are disconnected in response to lowering of the piston toward its second position, and means are provided on the piston to engage and lower the tubular member, as it continues to move to its lower position and the pin continues to move downwardly in the J-slot so as to set the packer. More particularly, the means releasably connecting the upper end of the tubular member to the mandrel and the lower end thereof to the packer setting sleeve forms a rigid, non-shearable connection between them which prevents downward movement of the packer setting sleeve with respect to the packer body as long as the piston is in its upper position.

Thus, as illustrated, a first collet on the upper end of the tubular member is held by the piston between the tubular member and mandrel engaged, and a second collet on the lower end of the tubular member is held between shoulders of the setting sleeve and tubular member and releasably connected to the tubular member to hold the shoulders engaged, with the first and second collets being disengaged as the tubular member moves downwardly with the piston. The second collet is then movable downwardly to engage the setting sleeve, upon its release from the setting sleeve, and means are provided on the tubular member for engaging the second collet, upon its release, and as the piston moves to its second position, so as to lower the sleeve to setting position.

BRIEF DESCRIPTION OF THE DRAWINGS

In the drawings, wherein like reference or characters are used throughout to designate like parts:

FIGS. 1A, 1B, 1C and 1D are longitudinal views, partly in section and partly in elevation, of the upper, upper intermediate, lower intermediate and lower positions of a tool constructed in accordance with the present invention and connected at its lower end to the body of the packer preparatory to lowering it into the well bore;

FIG. 1E is a developed sectional view of the pin carried by the first sleeve of the tool in a position it occupies in the J-sleeve thereof prior to lowering of the piston;

FIGS. 2A, 2B, 2C and 2D are views similar to FIGS. 1A–1D, but upon release and initial lowering of the piston to release the ends of the tubular member from connection to the mandrel and lower the tubular member into downwardly force transmitting relation with the upper end of the packer setting sleeve;

FIG. 2E is a view similar to 1E, but upon lowering of the J-sleeve with the tubular member to the positions of FIGS. 2A to 2D;

FIGS. 3A, 3B, 3C and 3D are views similar to FIGS. 1A–1D and 2A–2D, and upon further lowering of the piston to lower packer setting sleeve to setting position;

FIG. 3E and 3F are views similar to FIGS. 1E and 2E, but showing the relative positions of the J-sleeve and pin of the first sleeve when the tool is in its FIGS. 3A–3D position;

FIGS. 4A, 4B, 4C and 4D are views similar to FIGS. 1A–1D, 2A–2D and 3A–3D, but upon raising of the piston back towards its upper position so as to release the latch and thus the threads thereon from the left-hand threads of the body-of the packer;

FIG. 4E is a view similar to FIGS. 1E, 2E and 3E/3F, showing the relative positions of the J-sleeve and pin in the position of the tool shown in FIGS. 4A–4D;

DESCRIPTION OF THE PREFERRED EMBODIMENTS

Figure 3A:
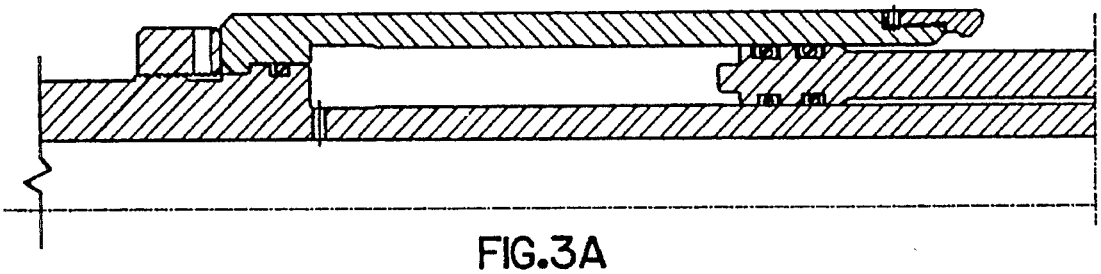

With reference now to the details of the above-described drawings, the setting tool, which is indicated in its entirety by reference character 20, comprises a tubular mandrel 21 adapted to be connected at its upper end (not shown) to a pipe string for lowering and then setting a packer, at a desired level within a wellbore, whereupon the tool may be retrieved from the well bore. As shown in part, the packer includes a main tubular body 23 having a bore 24 into which the lower end of the mandrel of the setting tool extends, and a setting sleeve 25 which surrounds the body and which, prior to setting of the packer, is releasably held in an upper position (FIGS. 1D and 2D) with respect thereto. As well-known to those skilled in this art, the sleeve is adapted to be lowered to set the packer and is held in its lower, packer setting position (FIGS. 3D and 4D) by means of ratchet teeth carried by a collet 26 on its inner side for engaging with ratchet teeth about the outer side of the packer body. As previously described, the packer may be used in a gravel pack operation, in which case the lower end of the mandrel of the setting tool is normally connected to a cross-over tool adapted to be raised and lowered with it within the bore of the packer. However, the invention contemplates that the packer may be used for other purposes, and hence its use should not be construed as a limitation on the claims of this invention.

The tubular mandrel 21 of the tool 20 includes an inner tubular body 30 which has a bore 31 therethrough forming a continuation of the bore of the string on which it is run, and a second tubular body 32 threadedly and sealably connected to the upper position of the inner tubular body 30 in surrounding relation thereto to form an annular space between them which is open at its lower end. A port 34 is formed in the inner tubular body to provide access between its bore and the upper end of an annular piston 35 vertically reciprocable within the space. As shown, the piston carries 0-rings 36 about its upper end to form a pressure chamber above it which is responsive to fluid pressure supplied thereto through port 34 to urge the piston in a downward direction. This pressure build-up is made possible by dropping a ball or other obstruction onto a seat below the bore of the mandrel. Conversely, and as will be described, when the packer is set, the piston is responsive to pressure within the annulus above the packer so as to urge the piston in an upward direction.

The outer tubular body 32 of the mandrel is connected to the setting sleeve 25 of the packer by means of a tubular member 37 which, as will be described in detail, forms a rigid, non-shearable connection between the mandrel and the setting sleeve which prevents premature setting of the packer as it is lowered into the wellbore with the setting tool. Thus, it prevents the downward movement of the setting sleeve with respect to the body of the packer body, during lowering of the packer with the setting tool to the desired level in the well bore, as might occur during its engagement with a tight area of the well bore, especially as it is moved into a substantially horizontal section thereof extending laterally from a vertical section leading to the surface by a sharp bend.

As shown in the drawings, left-hand threads 40 are formed about the bore of the packer body adjacent to its upper end, and, as compared with the previously described packer of this type, notches 41 are formed on its upper end. More particularly, and as can be seen from the elevational portion of FIG. 1D, these notches are of considerable width, and have an abrupt shoulder 40A on one side facing in a clockwise direction looking down with respect to the tool, and a tapered shoulder 40B on the other side face.

Upon lowering of the packer with the setting tool, left-hand threads 45 about the lower end of a latch 46 carried by the setting tool are held engaged with the threads 40 of the packer body so as to support the packer body and thus the packer from the setting tool. Thus, as shown, the latch comprises collet fingers 47 depending from a collar 48 about its upper end and having the threads 45 formed on their outer sides. Thus, when unrestrained, the collet fingers of the latch are free to flex inwardly to permit the threads to be threadedly disengaged from those of the packer body.

Figure 4A:
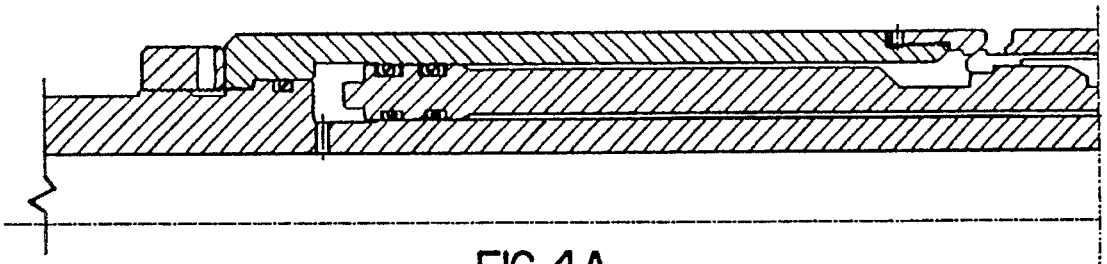

As the packer is lowered with the tool, the threads of the latch ring are restrained and thus held engaged with those of the packer body by means of a first sleeve 50 carried about an intermediate portion of the inner tubular body of the mandrel for vertical reciprocation with respect thereto. Thus, in the lower position of the sleeve shown in FIGS. 1D, 2D and 3D, it fits within the lower end of the latch to hold the threads thereon engaged with those of the packer body. However, upon raising of the sleeve 50, as shown in FIG. 4D, it is removed from beneath an inner enlargement on the end of the latch to permit its threaded collet fingers to flex inwardly.

Figure 6:
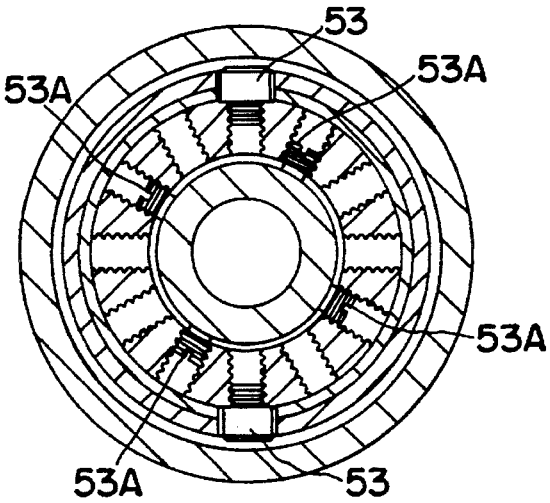
FIG. 6 is a cross-sectional view of the tool, as seen along broken lines 6—6 of FIG. 1B.
Figure 7:
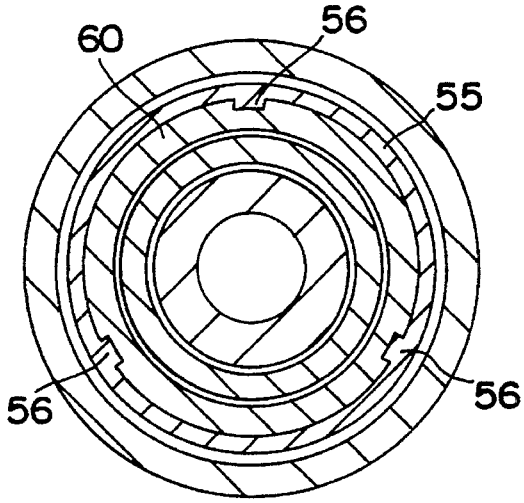
FIG. 7 is a cross-sectional view of the tool, as seen along broken lines 7—7 of FIG. 1C.

The sleeve 50 is releasably connected to the inner tubular body of the mandrel by means of shear pin 53A (FIG. 6) to hold it in its lower position as the packer is lowered with the setting tool. However, upon shearing of the pins 53A, the sleeve may be raised, following setting of the packer, to release the collet fingers and thus permit retrieval of the setting tool. Pins 51 are also carried by the latch sleeve for siding within a slot 52 in the collar at the upper end of the latch for shifting between a lower position adjacent the lower end of the slot, when the sleeve is in latch holding position, and an upper position (FIG. 4C), when the sleeve is raised to releasing position, to permit the latch to be raised with the sleeve and thus with the setting tool to permit its retrieval from the set packer. The portion of the sleeve 50 above the latch is vertically slidable within an annular space between the inner tubular body of the mandrel and an outer tubular body 60 thereof threadedly connected to the inner tubular body at its upper end.

Figure 2C:
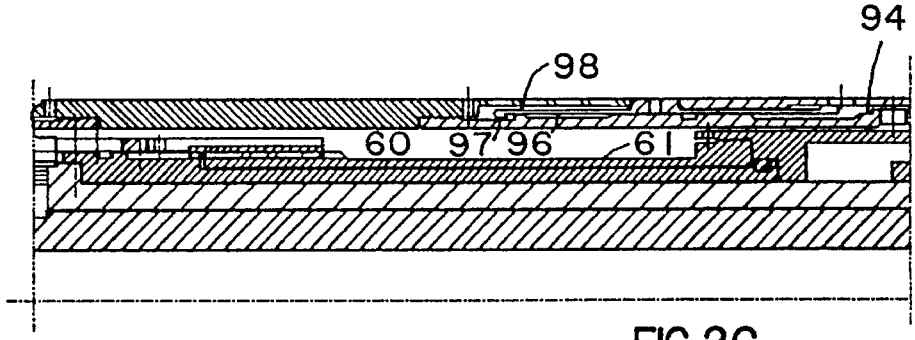
Figure 3F:
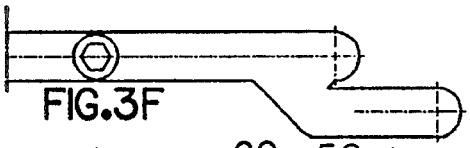
Figure 3C:
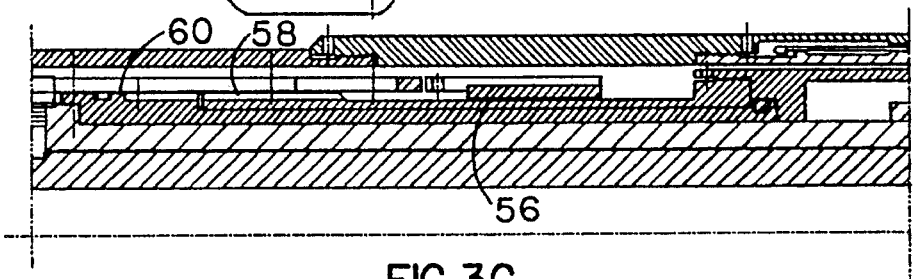
Figure 4C:
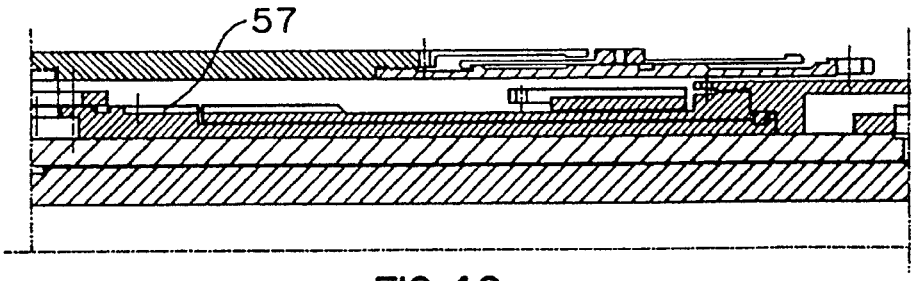
Figure 3D:
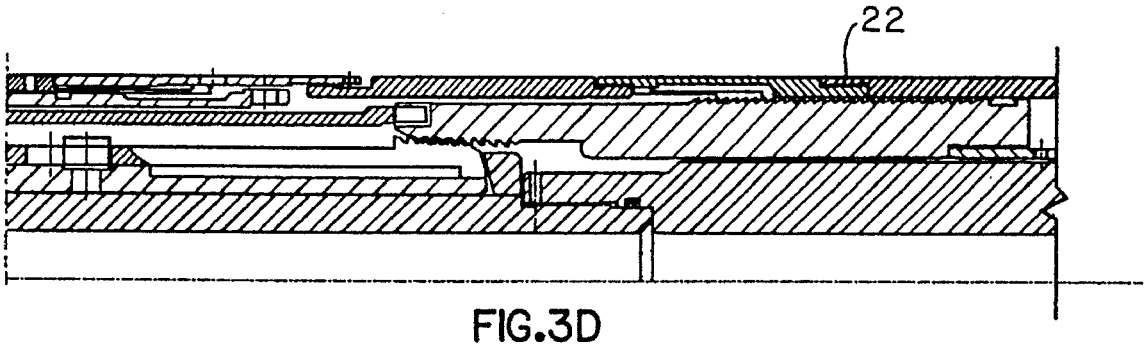
Figure 4D:
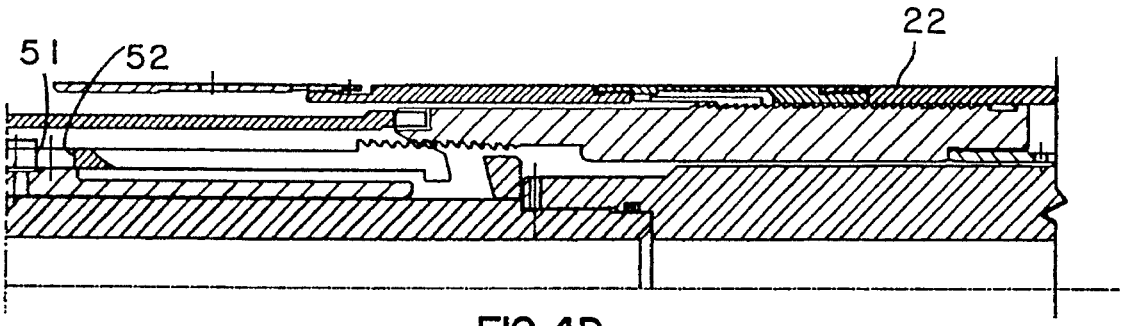
Figure 5:
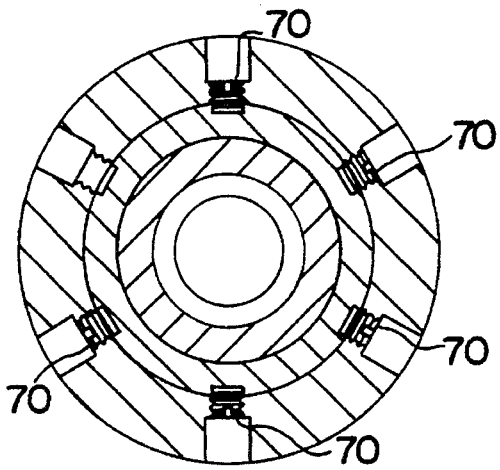
FIG. 5 is a cross-sectional view of the tool, as shown on broken lines 5—5 of FIG. 1.

As shown, outer tubular body 60 has a slot 54 therein in which the head of each pin 51 is slidable as the sleeve 50 is raised and lowered, and is surrounded by a sleeve 61 which is alternately connected to the tubular member 60 for rotation therewith (FIGS. 1C and 2C) and released for rotation with respect thereto (FIGS. 3C and 4C). The lower end of the sleeve 61 has square teeth 62 formed thereon which are disposable within the notches 41 on the packer body when the setting tool is connected to the packer, but which may be lifted from the notches upon setting of the packer and retrieval of the setting tool therefrom. Thus, as shown in FIG. 1D, the teeth have abrupt sides, one of which faces the abrupt side of the notch 41 in which it is disposed. Thus, with the sleeve connected to body 60 for rotation therewith, abutment of the abrupt sides on the teeth and notches prevents right-hand rotation of the setting tool with respect to the packer, as seen looking down. As previously described, this prevents premature release of the left-hand threads of the setting tool from those of the packer body during running of the tool, which rotation might occur, for example, during the right hand rotation of the packer while engaged with the well bore pipe string in an effort to "corkscrew" the pipe string into the well bore.

The sleeve 61 is held against rotation with respect to tubular body 60 by a key 55 comprising a ring having one or more ribs 56 on its inner diameter for sliding closely within grooves 57 and 58 formed about adjacent ends of the tubular body and sleeve 61 when the grooves are axially aligned. A shear pin 59 releasably connects the key ring 55 in an upper position (FIG. 1C) to hold sleeve 61 against rotation with respect to the mandrel. However, when the pin is sheared, in a manner to be described, the ring is free to be lowered (FIG. 3C) so as to release the tubular body 60 from the anti-rotation sleeve 61, and thus release the mandrel for rotation with respect to the packer. Consequently, the mandrel may be rotated to the right with respect to the packer body, and thus the latch may be rotated with the mandrel to release its threads from those of the packer body in the event they do not release upon raising of sleeve 50.

As previously described, the tubular member 37 is releasably connected at its opposite ends to the mandrel and the setting sleeve of the packer by collets, and the tubular member and packer are releasably connected to the shear pins 70, to form a rigid, non-shearable connection between them as they are lowered into the wellbore. However, as will be described in detail to follow, when fluid pressure is increased to a predetermined level, it shears pins 70 to permit downward movement of the piston to a position in which the connection of its opposite ends to the mandrel and packer are released and a shoulder 71 thereon engages a shoulder 72 on the tubular member, as shown in FIG. 2A.

Figure 1A:
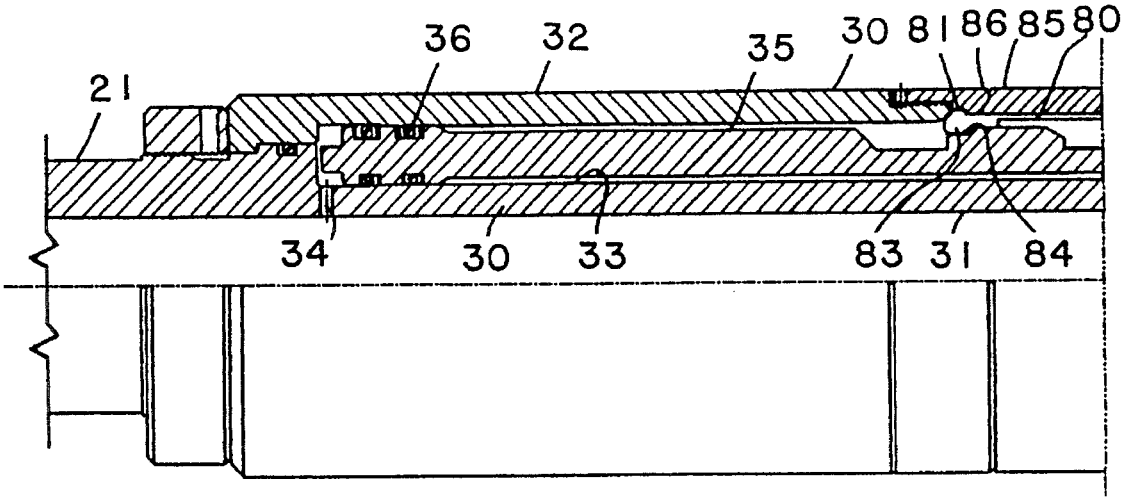
Figure 2A:
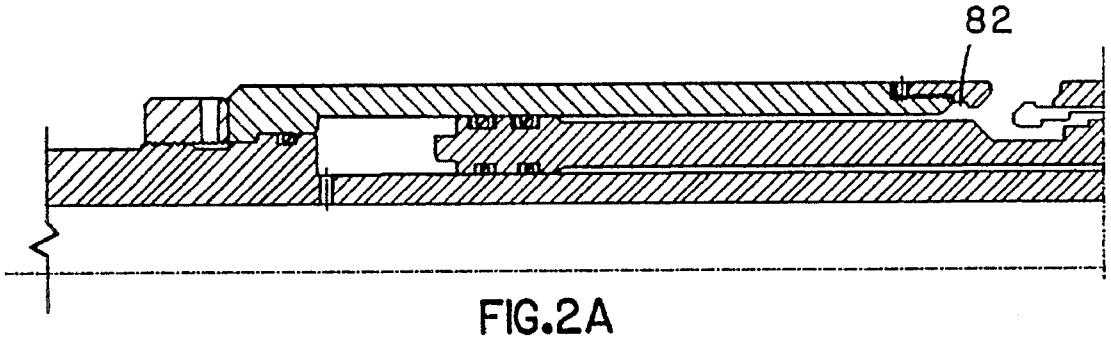
Figure 1C:
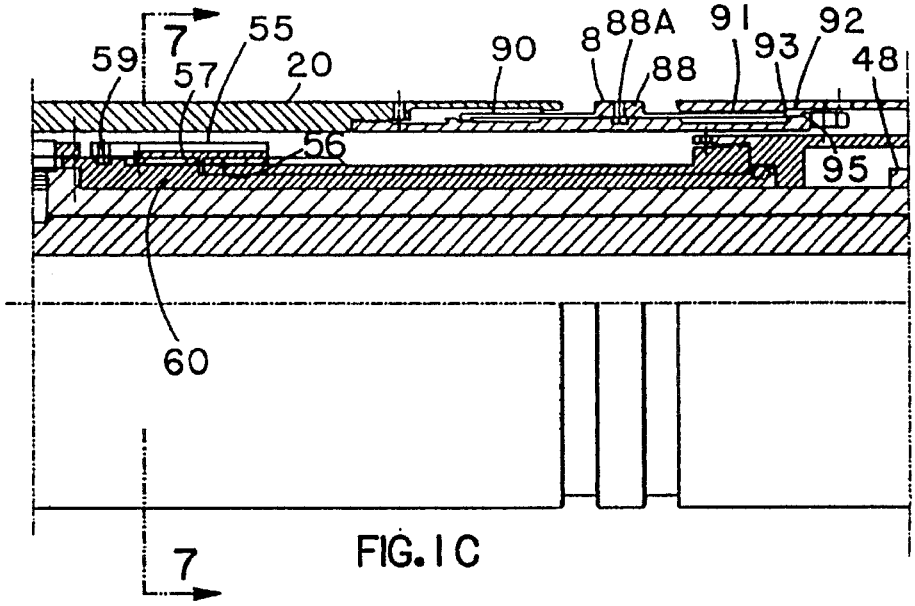
Figure 1D:
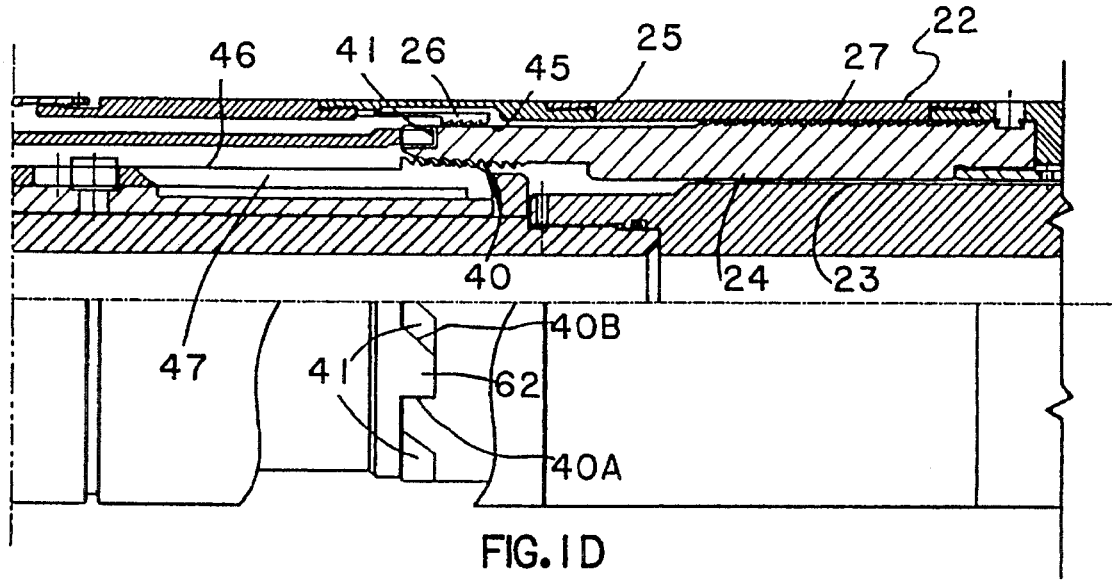
Figure 2D:
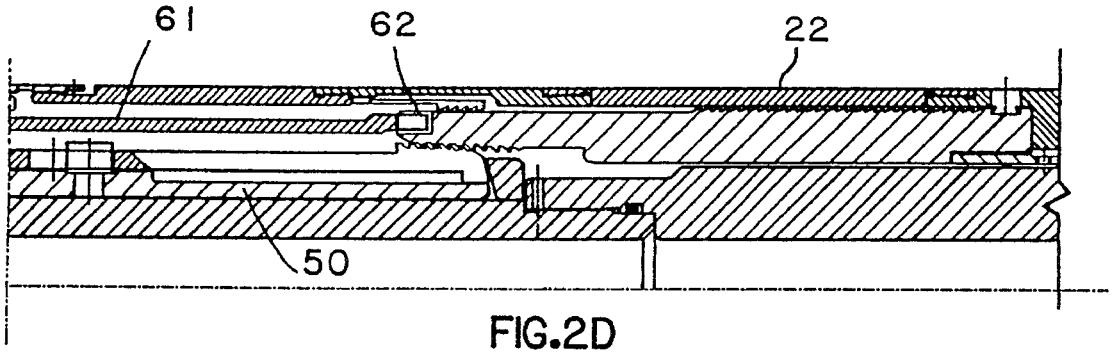

Thus, as the piston begins to move downwardly from the position of FIG. 1A to that of FIG. 2A, the outer side 84 thereof moves out from under the inner side of the head 81 of the upper collet 83 and thus permits the head to flex inwardly out of the groove 82 about the inner side of the body 32 of the mandrel. As will be described to follow, this downward movement of the tubular member with the piston also releases a lower collet from the packer setting sleeve (FIG. 2C), and then, upon continued downward movement, causes the collet to engage upper end of the setting sleeve and lower it further to set the packer.

A third J-sleeve 90 is supported at its upper end by the tubular member for rotation with respect thereto as well as raising and lowering therewith, and has a J-slot 91 formed therein opposite slot 54 in the mandrel to closely receive the head of shear pin 53. As shown in FIG. 1E, as the packer is being lowered with the setting tool, pin 53 is received in the lower end of the short leg of the slot. However, as the piston is released and the tubular member and J-sleeve are lowered with it, the sleeve 90 slides further over pin 53 to move its lower end against the key ring to release a shear pin 59, as shown in FIG. 2C. As the J-sleeve continues to be lowered with the piston to its lower position (FIG. 3C) to set the packer, the long end of the J-slot moves down over the pin 53 to further lower the key ring and thus release the second sleeve 61 for rotation with respect to the mandrel.

As previously described, upon setting the packer, the pressure in the annulus above it may be increased to test the packer, following which a further increase, along with a decrease in pressure within the mandrel, moves the piston upwardly from the lower position of FIG. 3A and 3B to the upper position thereof as shown in FIGS. 4A and 4B. This in turn raises the J-sleeve 90 until a seat on the lower end of its long run engages the pin 53 as shown in FIG. 4E, whereby further raising of the J-sleeve, the sleeve 50 is raised to its latch releasing position 46 so that the latch teeth are free to flex inwardly and thus to be released from the threads on the packer body.

The lower collet includes collet fingers 91 having enlarged heads 92 with upwardly and inwardly tapered surfaces engaging a similarly tapered shoulder 93 about the inner diameter of the setting sleeve 25. The heads 92 are initially held in such position by surface 94 formed about the outer diameter of the lower end of the tubular member. Thus, an upwardly facing shoulder 95 on the lower end of the surface engages the lowermost end of the enlarged heads 92.

Thus, as previously described, the collets at the ends of the tubular member provide a rigid, non-shearable connection mandrel and setting sleeve which prevents premature lowering of the setting sleeve, as might occur upon raising of the setting sleeve within a tight well bore, until the tubular member is released from the piston upon downward movement of the piston to shear the pin 70 in response to fluid pressure in the bore of the mandrel. As this occurs, the surface 84 moves out of supporting position with respect to the heads on the ends of the collet fingers 80, as the shoulder 71 on the piston moves downwardly into engagement with the shoulder 72 on the inner diameter of the tubular member so as to lower the tubular member with the piston, as shown in FIGS. 2A and 2B, which, as described, pulls the unsupported head of the collet fingers 80 from within the recess 82 to release the connection of the upper collet to the mandrel.

Downward movement of the released tubular member also moves the ring 88 of the lower collet against the upper end of the setting sleeve, so that continued lowering of the tubular member with the piston will shear a pin 88A connecting ring 88 to the tubular member, thus permitting further downward movement of the tubular member to move the heads on the lower end of the collet fingers 91 out of confinement by the surface 94 on the tubular member. consequently, the lower end of the tubular member is also released, and, since the confinement of the inner side of the heads of the collet fingers 91 is removed, as shown in FIG. 2C, they are free to flex inwardly and move upwardly past the inner shoulder 93 on the sleeve to permit the collet to be retrieved along with the lower end of the tubular member following setting of the packer.

The upper collet includes a further set of collet fingers 96 which extend upwardly from the central ring 88 and have heads 97 on their upper ends which are flexible with the collet fingers to permit them to be moved from the lower to the upper side of catch ring 98 formed about the tubular member, thus permitting the collet to be supported from the tubular member, as shown in FIG. 4C upon lifting of the setting tool from the set packer.

In addition to permitting the J sleeve 90 to move downwardly for the purpose of moving the key ring 53 out of locking engagement between the mandrel and the J-sleeve, the long run of the J slot permits the tubular member to continue to be moved downwardly with the piston from the position of FIGS. 2B and 2C to the position of FIGS. 3B and 3C, and thus, through engagement of the lower end of the ring of the lower collet with the upper end of the setting sleeve, cause the setting sleeve to be moved downwardly to set the packer and be locked in set position by means of the ratchet teeth 26 on the collet of the sleeve and matching ratchet teeth 27 about the body of the packer.

When the packer has been set, pressure in the annulus above it may be increased to test its sealing engagement with the well bore and move the piston upwardly. In response to a pressure higher than that required to set the packer, the J-sleeve will lift the sleeve 50 with sufficient force to shear pins 53A, and thus, through pins 51, the surface 84 about the piston re-engages the inwardly enlarged head portion 83 of the upper collet to lift the collet and thus the tubular member with the piston until the upper end of the collet engages the lower end of the outer tubular body of the mandrel, as shown in FIG. 4A.

As previously described, in the event the threads of the setting tool are not disengaged from those of the body of the packer, for whatever reason, the setting tool provides a means by which the threads of the tool may be rotated to the right to release them from those of the packer body. Thus, with the key sleeve lowered to release the sleeve 61 from rotation with the mandrel, the mandrel may be rotated to the right, thus rotating the threaded collet fingers of the latch sleeve with it to disconnect them from the left-hand threads of the body of the packer.

In any event, upon release of the threads of the latch fingers from the body of the packer, the teeth 62 are free to be lifted from the notches formed about the upper end of the body, thus permitting the setting tool to be lifted for retrieval from the well bore.

In assembling the tool, it is of course necessary to lower the piston, by whatever means, in order to permit the upper and lower collets to be moved into position for releasably connecting with the mandrel and packer, after which the packer may be raised to move the collets to latching position and hold them in such position. The wide notches in the packer body have facilitated placing the teeth on the lower ends of the mandrel between their widely spaced sides and then properly aligning the parts of the tool to receive the above described shear pins.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A tool for use in running and setting a well packer within a well bore, wherein the packer has a body and a setting sleeve releasably connected to the body for vertical shifting with respect thereto to set the packer within the well bore, and wherein the packer body has left-hand threads formed about its diameter and upwardly facing notches having abrupt sides, said tool comprising a mandrel adapted to be suspended from a pipe string and having a bore therethrough, an annular chamber about the bore, and a port connecting its bore with the chamber, an annular piston vertically reciprocable in the chamber between upper and lower positions, means holding said piston in its upper position but releasable to permit the piston to be moved toward its lower position in response to the supply through the port of fluid pressure thereto from within the mandrel bore, means including a tubular member lowerable with the piston to engage and lower the packer setting sleeve to packer setting position, a latch carried by the mandrel and having collet fingers with left-hand threads thereabout engageable with those of the packer body, a first sleeve carried by the mandrel for vertical movement with respect thereto between a first vertical position holding the latch threads of the collet fingers engaged with those of the packer body, to suspend the packer therefrom, and a second vertical position releasing the collet fingers and thus the threads thereon for retraction from those of the packer body, means releasably connecting the first sleeve to the mandrel to hold the first sleeve in its first vertical position, a second sleeve carried by the tubular member and having teeth thereabout which are received in the notches of the packer body and have abrupt sides opposite with the abrupt sides of the notches, when so received, means holding said second sleeve against rotation with respect to the mandrel so as to prevent rotation of the tool in a right-hand direction with respect to the packer body, as the packer is lowered with the tool into the well bore, said piston being raised from its lower to its upper position, in response to fluid pressure in the annulus about the tool above the set packer, means for lifting the tubular member with the piston responsive to lifting of the piston for releasing the connection of the first sleeve to the mandrel and raising said first sleeve to its second vertical position to permit the latch to disengage from the packer body, and means for continuing to lift the latch with the first sleeve and lift the first and second sleeves with the tubular member to permit the tool to be retrieved from the packer as the piston continues to be raised.

2. As in claim 1, including means holding the latch for rotation with the first sleeve, and means for releasing said means holding the second sleeve, as the tubular member is lowered, so as to permit the latch to be rotated with the mandrel in order to release its threads from those of packer body.

3. As in claim 2, wherein said releasable holding means comprises a key releasably connected to the mandrel and vertically slidably interfitting with the mandrel and second sleeve, and means on the tubular member for engaging the key to release said connection to the mandrel and move the key out of slidable interfitting relation with the mandrel in response to lowering of the tubular member with the piston.

4. As in claim 3, wherein the key is engaged and lowered by a third sleeve of the tubular member which is rotatable with respect to the mandrel, the third sleeve has a J-slot therein, the mandrel has a slot opposite the J-slot, and the first sleeve has a pin for sliding within the slot in the mandrel and the J-slot in the third sleeve and engageable by a shoulder on the J-slot to permit the first and second sleeves to be raised with the third sleeve upon release of the first sleeve from the mandrel.

5. As in claim 1, including means releasably connecting opposite ends of the tubular member to the mandrel and setting sleeve to form a rigid, non-shearable connection between them, means shearably connecting the tubular member to the piston so that the ends of the tubular member are disconnected in response to lowering of the piston toward its second position, and means on the piston to engage and lower the tubular member, as it continues to move to its lower position.

6. A tool for use in running and setting a well packer within a well bore, wherein the packer has a body and a setting sleeve releasably connected to the body for vertical shifting with respect thereto to set the packer within the well bore, and wherein the packer body has left-hand threads formed about its diameter, said tool comprising a mandrel adapted to be suspended from a pipe string and having a bore therethrough, an annular chamber about the bore, and a port connecting its bore with the chamber, an annular piston vertically reciprocable in the chamber between upper and lower positions, a latch carried by the mandrel and having collet fingers with left-hand threads thereabout engageable with those of the packer body, a first sleeve carried by the mandrel for vertical reciprocation with respect thereto between a first vertical position holding the latch threads engaged with those of the packer body, to suspend the packer therefrom, and a second vertical position releasing the latch threads for retraction from those of the packer body, means releasably connecting the first sleeve to the mandrel to hold the first sleeve in its first vertical position, a tubular member releasably connected at its upper end to the mandrel and at its lower end to the packer setting sleeve and to form a rigid connection between them which prevents downward movement of the packer setting sleeve with respect to the packer body as long as the piston is in its upper position, means connecting the piston to the tubular member in its upper position, but releasable, in response to the supply through the port of fluid pressure in the mandrel bore to the upper end of the piston, to permit the piston to move downwardly, said tubular member being lowerable with the piston to release its ends from connection to the mandrel and packer setting sleeve and being engageable with the setting sleeve, as it is so lowered, so as to release the connection of the setting sleeve to the packer body and thus lower the setting sleeve to set the packer as the tubular member continues to move downwardly with the piston to its lower position, said piston being engageable with the tubular member to lift it with the piston, when the piston is raised from its lower to its upper position in response to the supply thereto of fluid pressure in the annulus above the set packer, and means carried by the tubular member for engaging the first sleeve to release its connection to the mandrel and lift it to its second position to release the latch as the piston continues to move toward its upper position.

7. As in claim 6, including a first collet on the upper end of the tubular member which is held by the piston between oppositely facing shoulders on the tubular member and mandrel, and a second collet releasably connected to the lower end of the tubular member which is held between shoulders of the setting sleeve and tubular member, said first and second collets being released to separate from the shoulders as the tubular member moves downwardly with the piston, and the second collet being movable downwardly to engage the setting sleeve, upon its release, and being releasable from connection to the tubular member as the piston continues to move downwardly to lower the setting sleeve.

8. As in claim 7, including means on tubular member for lifting the second collet with it as tubular member is raised with the piston upon movement of the piston back toward its upper position.

* * * * *